US005766090A

United States Patent [19]

Orlowski

[11] Patent Number: 5,766,090

[45] Date of Patent: Jun. 16, 1998

[54] VIBRATION DAMPENING MATERIAL FOR PUTTER SHAFTS

[76] Inventor: Michael E. Orlowski, 79780 Olympia Fields, La Quinta, Calif. 92253

[21] Appl. No.: 187,521

[22] Filed: Jan. 28, 1994

[51] Int. Cl.[6] ..... A63B 53/10; A63B 53/12

[52] U.S. Cl. ..... 473/316; 473/318; 473/409; 473/313

[58] Field of Search ..... 273/167 R, 77 R, 273/80 R, 80 B, DIG. 7, DIG. 23, 167 H; 473/316–323, 345, 346, 409, 313

[56] References Cited

U.S. PATENT DOCUMENTS

| | | | |
|---|---|---|---|
| 1,894,841 | 1/1933 | Adams | 273/170 |
| 1,950,342 | 3/1934 | Meshel | 273/80 B |
| 2,768,921 | 10/1956 | Pigg | 273/80 R |
| 3,083,969 | 4/1963 | Bills | 273/80 B |
| 3,468,538 | 9/1969 | Johnson | 273/80 R |
| 3,762,707 | 10/1973 | Santorelli | 273/80 B |
| 4,118,033 | 10/1978 | Miyamoto | 273/80 B |
| 4,516,778 | 5/1985 | Cleveland | 273/167 H |
| 4,650,626 | 3/1987 | Kurokawa | 273/167 R |
| 4,778,185 | 10/1988 | Kurokawa | 273/167 H |
| 5,007,643 | 4/1991 | Okumoto | 273/DIG. 23 |
| 5,082,279 | 1/1992 | Hull | 273/170 |
| 5,135,227 | 8/1992 | Okumoto | 273/DIG. 7 |
| 5,260,121 | 11/1993 | Gardner | 428/224 |
| 5,306,450 | 4/1994 | Okumoto | 273/DIG. 23 |

FOREIGN PATENT DOCUMENTS

| | | | |
|---|---|---|---|
| 2200560 | 8/1988 | United Kingdom | 273/171 |

*Primary Examiner*—Sebastiano Passaniti
*Attorney, Agent, or Firm*—Edgar W. Averill, Jr.

[57] ABSTRACT

An improved putter of the type which has a filled hollow shaft. The improved putter has a shaft which is filled with a resin, which in turn, is filled with micro-balloons. The filling bonds to the interior of the putter shaft and is essentially concompressive giving the putter a vastly improved feel.

6 Claims, 1 Drawing Sheet

FIG. 1
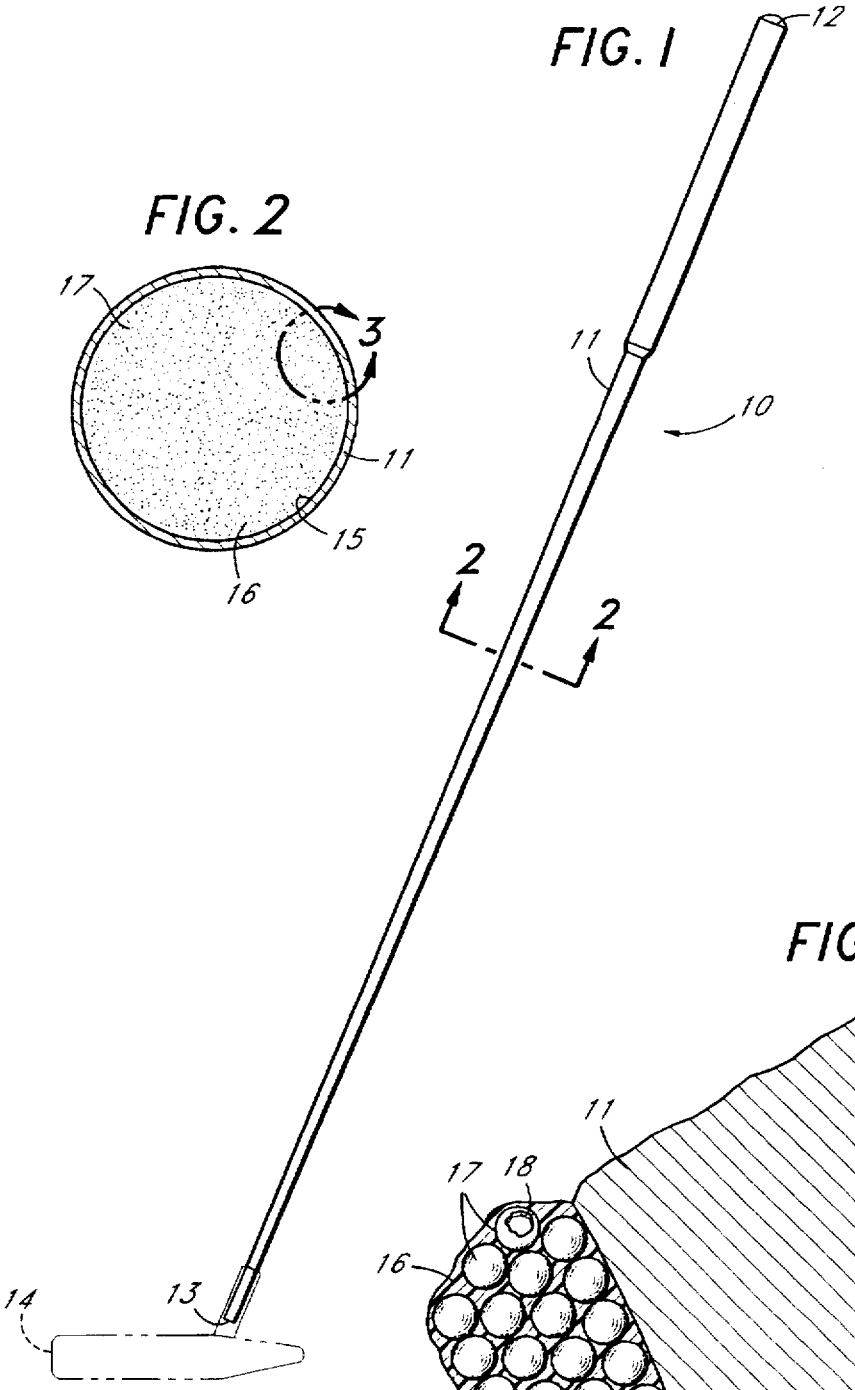
FIG. 2
FIG. 3
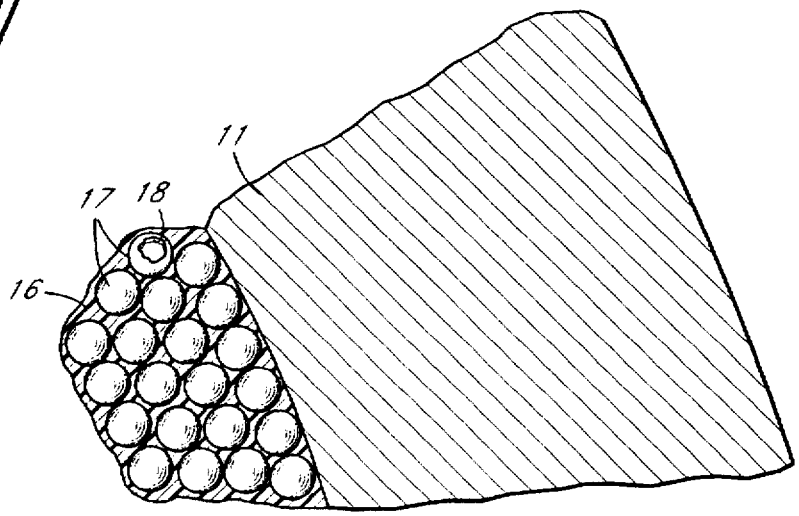

VIBRATION DAMPENING MATERIAL FOR PUTTER SHAFTS

BACKGROUND OF THE INVENTION

The field of the invention is golf clubs and the invention relates more particularly to putters and putter shafts.

Putters have been designed with various shapes and materials in an attempt to find an optimum golf club. The majority of the putters being sold today are made of a metal blade and a hollow steel or graphite shaft. The design goal for all putters is to maximize the sweet spot, or the preferred area on the face of the putter where the golf ball can be struck, and to provide the user with a "good" feel when striking the ball.

When a golf ball is struck by a putter blade a series of vibrations travel up the putter shaft to the players hands. If the ball is struck in the sweet spot a "true" vibration occurs which creates the solid feel that is desired by the player. When the player strikes the putt off the sweet spot of the putter blade the "true" vibration occurs, but is accompanied by a series of "noisy" vibrations. These are the vibrations that create that cause a putter to "shake" in a players hands.

The current invention is for a material that can be placed in any putter shaft that will dampen or filter out the "noisy" vibrations that were discussed above.

SUMMARY OF THE INVENTION

It is an object of the present invention to provide an improved putter that will dampen vibration initiated when the putter blade strikes a ball. The present invention is for an improved putter of the type having a hollow shaft with a rubber or leather grip at the handle end and a head at the putting end and having a volume of air within the interior of the putter shaft. The improvement of the present invention comprises a rigid filling material to replace the air in the shaft. The rigid filling material comprises an epoxy resin filled with small, hollow, spheres known as microballoons which provide an essentially non-compressible filling which is bonded to the interior surface of the putter shaft. Preferably the microballoons are made from glass, ceramic, or carbon and comprise about 35% by weight. The present invention is also for the process of improving the feel of a putter comprising the steps of opening the handle end of the putter shaft. Next a liquid mixture is prepared by mixing an epoxy resin with a hardener or catalyst and then adding at least about 35 percent by weight of the selected microballoon and mixing this mixture until it is homogenous in nature. Next the mixture is loaded into a disposable plastic cartridge known as a "Semco" cartridge. The mixture is the injected, using air pressure into the interior of the putter shaft from the handle end and allowed to cure at room temperature.

BRIEF DESCRIPTION OF THE DRAWINGS

FIG. 1 is a perspective view of the improved putter of the present invention.

FIG. 2 is an enlarged cross-sectional view taken along line 2—2 of FIG. 1.

FIG. 3 is an enlarged cross-sectional view taken along the line 3—3 of FIG. 2.

DESCRIPTION OF THE PREFERRED EMBODIMENTS

The improved putter of the present invention is shown in FIG. 1 and indicated generally by reference character 10. The putter as shown in FIG. 1 is conventional and has a putter shaft 11 which has a handle end 12 and a blade end

13 which is closed by a head 14 shown in phantom view in FIG. 1. The putter shaft 11 is filled with a rigid but lightweight material shown best in FIGS. 2 and 3 of the drawing. As shown in FIG. 2 putter shaft 11 has an interior surface 15 which contacts a cured epoxy resin 16 which is filled with microballoons 17. The microballoons 17 are hollow as shown best in FIG. 3 where it can be seen that the microballoons 17 have a wall 18. The wall 18 may be glass, ceramic, carbon, or other material but the resulting microballoon mixture is essentially non-compressible so that the putter shaft 11 has a very different and improved feel during putting. The amount of microballoons is preferably between 30% and 40% by weight of the resin.

The process for filling shaft 11 comprises the following steps. First, an epoxy resin and catalyst or curing agent are mixed together in a conventional manner and next about 35 percent by weight of the microballoons are added and thoroughly mixed into the epoxy resin mixture. The microballoon mixture is next placed into a plastic non-reusable cartridge commonly referred to as a "Semco" cartridge. The cartridge is then placed into an air gun known as a "Semco" gun. "Semco" refers to the manufacturer of the plastic cartridge and air gun. Then using air pressure the microballoon mixture is injected into the putter shaft 11 through the handle end 12 until the shaft is completely filled. The filled putter shaft is then allowed to cure at room temperature for at least 12 hours.

In addition to the improved feel of the present invention the additional weight that is added to the putter shaft 11 raises the center of gravity of the putter and places more weight above the ball. It is believed that this provides for a more true roll of the putted ball and improves distance control.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An improved putter of the type having a hollow shaft with a handle at one end and a putter head at the other end and having a volume of air within the interior of said putter shaft, wherein the improvement comprises:

a rigid filling replacing the air within said putter shaft, said rigid filling comprising an epoxy resin filled with microballoons, said filling being bonded to the interior of said shaft.

2. The improved putter of claim 1 wherein the microballoons comprise about 35 percent by weight.

3. The improved putter of claim 1 wherein the air is essentially completely replaced.

4. The improved putter of claim 1 wherein the microballoons are made of a rigid material selected from the group consisting of glass, ceramic, and carbon.

5. A process for improving the feel of a putter having a hollow shaft with a handle at one end and a putter head at the other end comprising the steps of:

mixing a liquid epoxy resin with a hardener and at least 35 percent by weight of microballoons to provide a microballoon filled liquid epoxy resin;

injecting said microballoon filled liquid epoxy resin into the handle end of the putter shaft; and permitting the epoxy resin to cure within said putter shaft.

6. The process of claim 5 wherein said microballoons comprise about 35 percent by weight.

* * * * *